United States Patent [19]

Woinarski

[11] 4,378,895

[45] Apr. 5, 1983

[54] CONTAINER-CLOSURE ARRANGEMENT

[75] Inventor: Peter A. Woinarski, Woollahra, Australia

[73] Assignee: Innovative Design Company Pty. Limited, Woollahra, Australia

[21] Appl. No.: 332,561

[22] Filed: Dec. 21, 1981

[30] Foreign Application Priority Data

Jan. 27, 1981 [AU] Australia ..... PE7371

[51] Int. Cl.[3] ..... B65D 41/16; B65D 41/18

[52] U.S. Cl. ..... 220/306; 220/284; 206/508; 150/0.5

[58] Field of Search ..... 220/306, 307, 284; 150/0.5; 206/508

[56] References Cited

U.S. PATENT DOCUMENTS

| | | | |
|---|---|---|---|
| 4,210,258 | 7/1980 | Von Holdt | 220/306 |
| 4,256,240 | 3/1981 | Woinarski | 220/306 |
| 4,293,080 | 10/1981 | Uetica | 220/306 |
| 4,308,970 | 1/1982 | Von Holdt | 220/306 |
| 4,334,631 | 6/1982 | Ballester | 220/306 |

*Primary Examiner*—George T. Hall

*Attorney, Agent, or Firm*—Ladas & Parry

[57] ABSTRACT

A product container which is suitable for retaining flowable type materials and which comprises a container portion and a removable closure portion, both of which are formed from a semi-rigid thermoplastics material. The container portion has a marginal lip which incorporates an inwardly directed bead which defines an opening to the container. The closure has a central region which locates within the container opening and an inverted U-shaped rim portion which engages the lip of the container. The rim portion of the closure includes an inner skirt which locates within the lip of the container, which incorporates an outwardly projecting ledge which engages with an undercut below the container bead, and which flares downwardly and inwardly to merge with the central portion of the closure. The flared portion of the closure skirt incorporates a zone having a section thickness which is less than that of the adjacent portions of the closure, whereby the closure will tend to deform predominently in such zone in the event that the closure is subjected to an impact force, and the zone of reduced section thickness is disposed generally on an imaginary line which extends upwardly and outwardly at an acute angle to the longitudinal axis of the container.

13 Claims, 10 Drawing Figures

CONTAINER-CLOSURE ARRANGEMENT

FIELD OF THE INVENTION

This invention relates to a product container which includes a container portion and a closure portion, both such portions being formed from plastics material. In particular, the invention is directed to the mating configuration and/or arrangement of the container and closure portions.

The product container may be used for retaining various materials, including solids, liquids or particulate materials, but it has been designed expressly for the purpose of retaining flowable type materials such as adhesives or paints which customarily are packaged in steel cans to which a steel closure is press-fitted.

BACKGROUND OF THE INVENTION

In order that a plastics material product container might be adopted as an acceptable substitute for a metal container, the plastics material product should meet certain criteria. It should be reusable, in the sense that the closure should be capable of resealing the container portion following successive openings. The primary seal between the closure and the container portions should be made internally of the container wall, in order that the container might be dimensioned for compatibility with conventional labelling machinery. The closure should provide an hermetic seal with the container portion but be readily removable from the container portion with use of a prising implement such as a screwdriver blade. Finally, the container-closure arrangement should be capable of absorbing the energy of normally encountered impact forces without the closure being caused to break away from the container portion.

Various prior art product containers have been developed in an attempt to meet the above stated criteria but, to the knowledge of the present inventor, no prior art container has met the seemingly incompatible requirements for a satisfactory impact resistant container-closure seal and convenient removability of the closure from the container. The inventor has found that, in practice, some prior art containers which have been developed for packing liquid materials such as paint have met the need for relatively easy removal of the closure from the container by providing a small interference seal between the closure and container portions or by forming the closure from very soft deformable materials such as low density polyethylene, but, as a consequence, such arrangements exhibit a poor resistance to impact forces.

Of all the prior art product containers of which the inventor is aware, it is thought that those disclosed by U.S. Pat. No. 3,977,563 and U.K. Pat. No. 1,388,331 are the most relevant in the context of the present invention. However, for reasons which will become clear from further reading of this specification, it is sufficient to say that, in the case of both of the referenced patents, the disclosed prior art closures do not incorporate wall portions which have a reduced thickness in a region which is strategically located for the purpose of elastically absorbing impact forces, and, at the same time, causing increased sealing between the closure and container portions.

SUMMARY OF THE INVENTION

The present invention seeks to provide a container-closure structure which functions elastically to absorb impact energy and, at the same time, to increase the sealing effect between the closure and container portions. This latter effect is achieved by locating the closure-to-container seal internally of the container wall and by employing a closure configuration as below defined.

Thus, the invention provides a container-closure arrangement comprising a plastics material container and a plastics material closure therefor. The container has a lip incorporating a radially inwardly directed bead which defines an opening to the container, and the closure comprises a central portion which locates within the container opening and a rim portion which engages the container lip when the closure is fitted to the container. The rim portion of the closure includes an inner skirt which locates within the lip of the container. The inner skirt includes a radially outwardly projecting ledge which normally engages with an undercut below the container bead, and the inner skirt is formed with a portion which depends below the ledge and which flares downwardly and radially inwardly to merge with the central portion of the closure. The flared portion of the closure incorporates a zone having a section thickness which is less than that of the adjacent portions of the closure whereby the closure will tend to deform predominantly in such zone in the event that the closure is subjected to an impact force, and the zone of reduced section thickness is disposed generally on an imaginery line which extends upwardly and outwardly at an acute angle to the longitudinal axis of the container.

With the above defined container-closure arrangement, if the closure is subjected to an impact force and the closure therefore deforms predominantly in the region of the thin-section flared zone of the closure, an elastic force will be exerted against the ledge of the closure whereby it is forced into positive sealing engagement with the bead undercut in the container.

PREFERRED FEATURES OF THE INVENTION

The container preferably has a circular cross-section cylindrical form and, thus, preferably has a circular opening to which the closure is fitted. However, the container may have other configurations, such as an elliptical, polygonal or square cross-section.

Also, the closure preferably has an inverted generally U-shaped said rim portion which overfits the container lip when the closure is fitted to the container. With such construction, the rim portion of the closure will include a peripheral skirt which locates about the lip of the container.

The invention further provides a closure component per se of the type above defined and a container component per se also of the type as above defined, such components being interengagable.

The invention will be more fully understood from the following description of a preferred embodiment of a complete product container which is illustrated by way of example in the accompanying drawings.

DETAILED DESCRIPTION OF THE INVENTION

Figure 1:
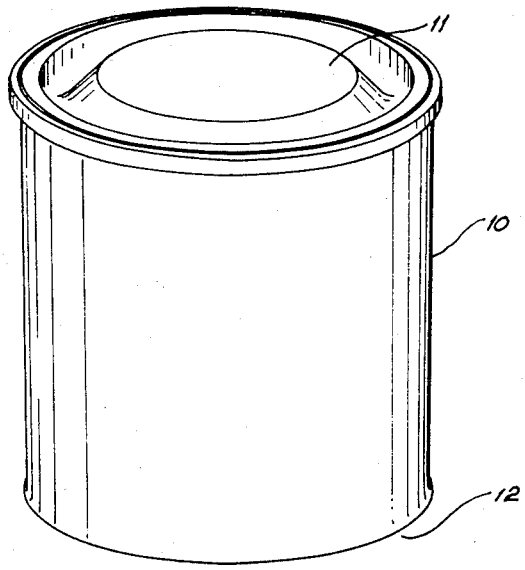
FIG. 1 shows a perspective view of an assembled product container having a closure fitted to a container portion.

As illustrated, the container-closure arrangement comprises a generally cylindrical container 10 and a generally disc-shaped closure 11.

The container has a base portion 12, a peripheral wall 13, and a rim portion 14 which borders a central opening to the interior of the container.

Figure 2:
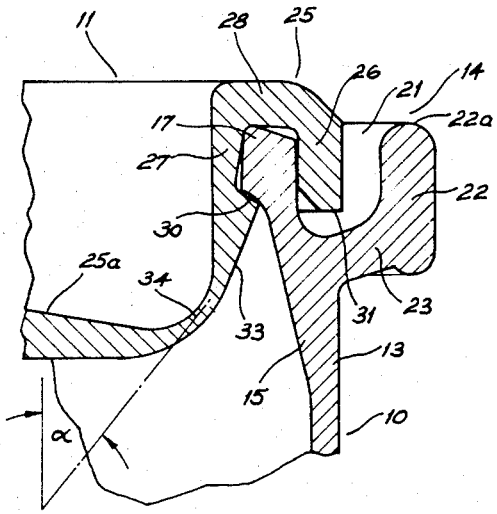
FIG. 2 shows an enlarged-scale sectional elevation view of a peripheral portion of the closure and container rim, with the closure fitting the container in sealing engagement.
Figure 2A:
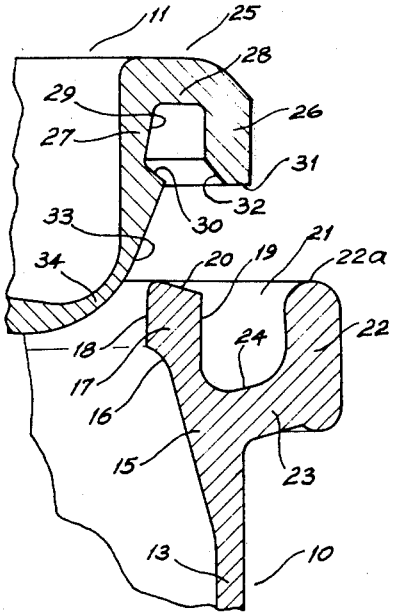
FIG. 2A shows the same arrangement as FIG. 2 but with the container and closure portions separated one from the other.

As best seen in FIGS. 2 and 2A, in the region of the rim portion 14 of the container, an inner surface 15 of the container wall 13 tapers inwardly and merges by way of radius 16 into a bead 17. The bead 17 has an inner periphery 18 which defines the opening of the container, and the radiused portion 16 forms an undercut below the bead.

The bead 17 has an outer periphery 19 which is concentric with the inner periphery 18, and the bead 17 is disposed radially within a projection of the peripheral wall 13 of the container. An upper surface 20 of the bead 17 forms the lip of the container and it tapers downwardly in a direction toward the outer periphery 19 of the bead.

An annular groove-like recess 21 surrounds the bead 17 and is defined in part by a concentric wall 22. The wall 22, which lies radially outwardly of the container wall 13, is joined to the container wall by a flange portion 23. The upper surface 24 of the flange portion 23 or, expressed otherwise, the lower surface of the recess 21 is disposed below the level of the undercut 16 at the underside of the bead 17.

The upper margin 22*a* of the concentric wall 22 lies approximately in the same plane as the lip 20 of the container.

The rim portion 14, including the tapered wall portion 15, bead 17, concentric wall 22 and flange portion 23, constitutes a relatively rigid structure which is intended to resist forces which would tend to deform the structure from its normal circular configuration.

The closure 11 has an inverted generally U-shaped peripheral portion 25, which locates about the container bead 17, and a central region 25*a*.

As best seen from FIGS. 2 and 2A of the drawings, the peripheral portion or rim 25 of the closure includes an outer downwardly projecting skirt 26 which surrounds the outer periphery 19 of the container bead, a radially inner downwardly projecting skirt 27 which is positioned adjacent the inner periphery 18 of the bead, and a laterally projecting portion 28 which connects the two skirts 26 and 27 and which overlies the lip surface 20 of the bead.

The bead abutting surface 29 of the inner skirt 27 is tapered in a direction which reduces the sectional thickness of the skirt in the region of the bead undercut 16 and, thereafter, the sectional thickness of the skirt increases to form a ledge 30 which lies below and engages with the undercut 16. The ledge-to-undercut engagement provides the primary seal between the closure and the container.

A small void exists between the container bead 17 and the inner skirt 27 of the closure due to the presence of the tapered surface 29, and a similar void exists between the container lip 20 and the laterally projecting portion 28 of the closure. Such voids serve as anti-capillary gaps and inhibit migration of fluid around the lip 20 of the container.

In the structure that has been described thus far, it can be seen that three circularly extending zones of contact exist between the container and the closure. Thus, the above mentioned primary seal exists between the closure ledge 30 and the container undercut 16, a secondary seal extends around the lip 20 of the container, and a tertiary seal extends around the outer periphery 19 of the container bead where it is contacted by the outer skirt 26 of the closure. The seals are maintained, in the absence of any externally applied breaking force, by resilient interengagement between the closure and container rims.

The outer skirt 26 of the closure extends into the recess 21 which surrounds the container, and the lower margin 31 of such skirt aligns with or, preferably, extends below the level of the ledge 30. A chamfer 32 is formed within the skirt 26 to facilitate displacement of the skirt from the rim of the container, as will hereinafter be described.

Reference is again made to the radially inner skirt 27 of the closure. In projecting below the ledge 30, the inner wall 33 of the skirt 27 tapers in a direction toward the centre of the closure and the sectional thickness of the skirt 27 decreases to a minimum over the region of an intermediate curved portion 34 of the closure which connects the peripheral region 25 of the closure to the central region 25*a*.

The thin-section zone or intermediate portion 34 is disposed generally along an imaginery line which extends upwardly and outwardly at an acute angle $\alpha$ to the longitudinal axis of the container, as indicated in FIG. 2, and, thus, the lower portion of the skirt may be considered as flaring downwardly and inwardly to merge with the central region 25*a* of the closure.

The central region 25*a* of the closure has a sectional thickness which is greater than that of the intermediate portion 34 and the central region therefore exhibits a greater degree of rigidity than the thin-section intermediate portion 34.

Figure 3:
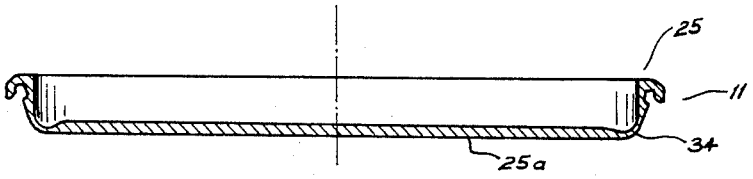
FIG. 3 shows a sectional elevation view of a first type of closure which is suitable for fitting to the illustrated container.
Figure 4:
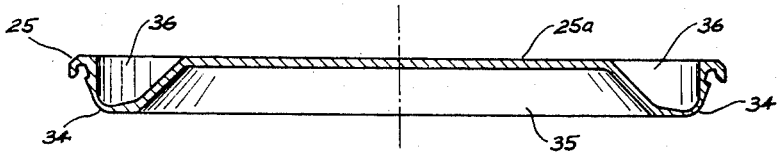
FIG. 4 shows a sectional elevation view of a second type of closure which is suitable for fitting to the container.
Figure 5:
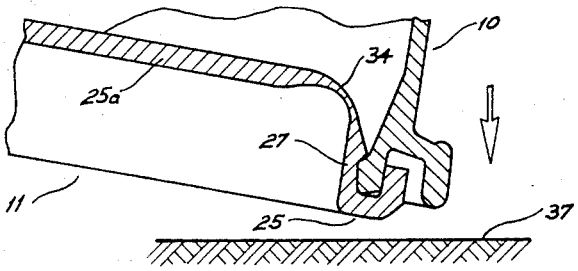
FIG. 5 illustrates a scrap view of the container-closure arrangement of FIG. 1 but in an inverted condition and falling toward a solid surface.
Figure 6:
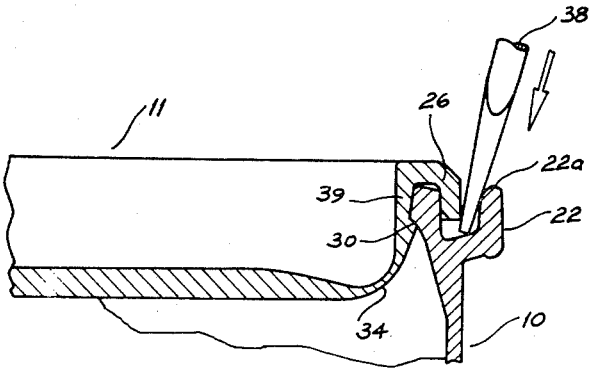
FIG. 6 shows a sectional elevation view of a peripheral portion of the container-closure arrangement under a condition in which the closure is about to be prised from the container by a prising implement.
Figure 7:
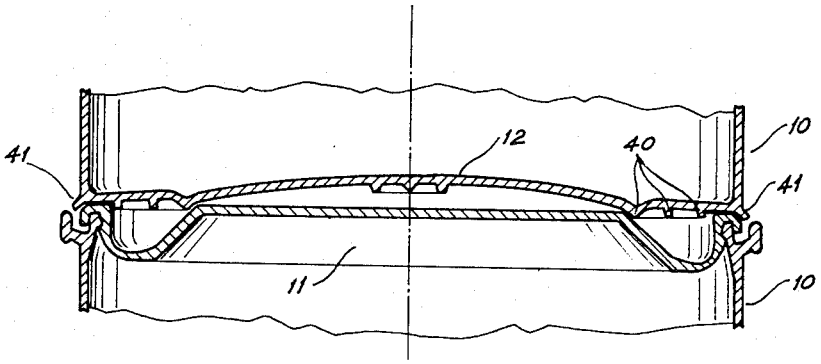
FIG. 7 shows a sectional elevation view of the base portion of one container stacked upon the closure of a lower container-closure assembly.

The central region 25*a* of the closure may be flat, as shown in FIGS. 3, 5 and 6 of the drawings, or it might incorporate an inverted well 35 having a surrounding annular channel 36 as shown in FIGS. 1, 4 and 7. However, in both cases, the central region 25*a* of the closure is joined to the peripheral region 25 by the thin-section intermediate portion 34.

Figure 5A:
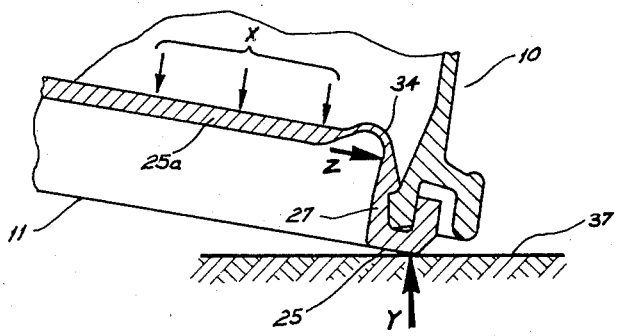
FIG. 5A shows the same arrangement as FIG. 5 but under a condition that exists following impact of the container-closure arrangement with the solid surface.

The thin-section intermediate portion 34 is incorporated in the closure so as to provide a zone which will deform elastically in the event that the container-closure arrangement is subjected to an impact force and which will thereby absorb such an impact force as would otherwise tend to break the closure-container seals and cause dislodgement of the closure from the container. The way in which the intermediate portion 34 performs this function is illustrated in FIGS. 5 and 5A. FIG. 5 shows an inverted container falling toward a solid surface 37 and FIG. 5A shows the container impacting with the solid surface.

During a period of free fall, as illustrated in FIG. 5, no significant dislodgement forces will be exerted on the closure. However, when the closure impacts with the surface 37, the contents of the container will exert a force on the underside of the closure, as indicated by the force lines X, and a reactive force (indicated by force line Y) will be exerted on the rim of the closure. The combined affect of these two forces will then cause the central region 25*a* of the closure to move downwardly relative to the rim 25 of the closure, and such relative movement is accommodated by elastic deformation of the thin-section intermediate portion 34. Thus, in making the transition between the conditions shown in FIGS. 5 and 5A respectively, the radius of curvature of the intermediate portion 34 reduces and a reactive force (as indicated by arrow Z in FIG. 5A) is exerted against the inner skirt 27 of the closure. This in turn causes enhancement of the seal between the closure ledge 30 and the container undercut 16, because the central portion 25*a* of the closure exhibits a greater degree of radial rigidity than the thin-section intermediate portion 34 and the closure ledge 30 therefore tends to move in a radially outward direction under the influence of the reactive force Z.

Figure 6A:
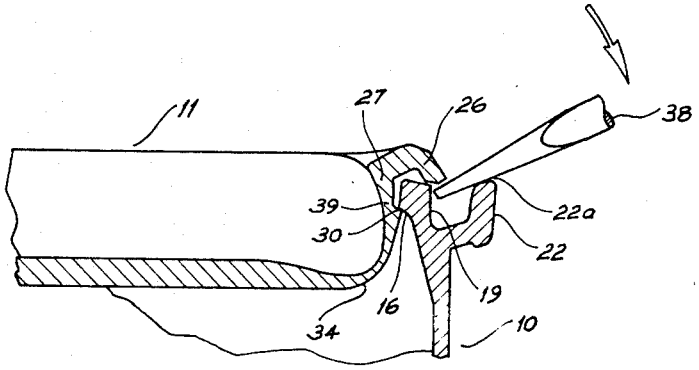
FIG. 6A shows a successive stage of the prising operation.

If it is required that the closure should be removed from the container, a prising tool 38 is employed in the manner shown in FIGS. 6 and 6A.

Under normal circumstances, the surrounding wall 22 of the container protects the outer skirt 26 of the closure from inadvertent dislodgement from the container, and it also serves to impart a degree of rigidity to the total structure. However, when it is desired to remove the closure from the container the upper margin 22*a* of the wall 22 provides a fulcrum for the prising tool 38.

During the initial opening stage, the rim of the closure is caused to bend about the region 39 of the inner skirt 27 which lies just above the ledge 30. At the same time the outer skirt 26 moved up the outer periphery 19 of the container rim until the chamfer 32 rests on the lip 20 of the container. During this process the two skirts 26 and 27 remain substantially parallel, due to the section thickness of the major portion of the skirts being large relative to the section thickness of the region 39, and, once the chamfer 32 engages with the lip 20 of the container, a condition of equilibrium is established which operates against any tendency that the outer skirt 26 might otherwise have to move back into the recess 21.

Continued prising causes the closure to bend about the thin-section intermediate portion 34 of the closure until the ledge 30 moves away from the undercut 16 of the container.

The above described prising operation is effected at arcuately spaced points around the rim of the closure in order to permit complete release of the closure from the container.

Reference is now made to FIG. 7 of the drawings which shows a cross-sectional elevation view of the base of one container seated upon the closure of a lower container-closure arrangement. The base portion 12 of the container is generally concave and it includes a number of downwardly projecting concentric ridges 40 which serve to locate the upper container centrally of the lower closure. Also, the base of the container includes an outwardly extending flare 41 which complements the shape of the rim of the lower closure to facilitate stacking. The load of a stacked container is transferred to the wall of the lower container by way of the rim of the lower container's closure, rather than by way of the central region of the closure.

The container and closure may be moulded from a semi-rigid thermoplastics material such as high density polyethylene or polypropylene. Generally, better results are obtainable if the closure is moulded from a material which is slightly more flexible than that of the container and, typically, the closure might be moulded from a polyethylene material having a density in the order of 0.935 to 0.950. The container might typically be moulded from polyethylene material having a density in the order of 0.955 to 0.960.

I claim:

1. A container-closure arrangement comprising a plastics material container and a plastics material closure therefor; the container having a lip incorporating a radially inwardly directed bead which defines an opening to the container, and the closure comprising a central portion which locates within the container opening and a rim portion which engages the container lip when the closure is fitted to the container; the rim portion of the closure including an inner skirt which locates within the lip of the container, the inner skirt having a radially outwardly projecting ledge which normally engages with an undercut below the container bead, and the inner skirt being formed with a portion which depends below the ledge and which flares downwardly and radially inwardly to merge with the central portion of the closure; the flared portion of the closure incorporating a zone having a section thickness which is less than that of the adjacent portions of the closure whereby the closure will tend to deform predominatly in such zone in the event that the closure is subjected to an impact force, and the zone of reduced section thickness being disposed generally on an imaginary line which extends upwardly and outwardly at an acute angle to the longitudinal axis of the container.

2. The arrangement as claimed in claim 1 wherein the container has a cylindrical wall and a circular opening to which the closure is in use fitted.

3. The arrangement as claimed in claim 2 wherein the closure has an inverted generally U-shaped said rim portion which overfits the container lip when the closure is fitted to the container; the U-shaped rim portion comprising said inner skirt which locates within the lip of the container, an outer skirt which surrounds the outer periphery of the container lip and a laterally projecting portion which connects the two skirts.

4. The arrangement as claimed in claim 3 wherein the inner surface of the container wall tapers inwardly and upwardly and merges by way of said undercut with the bead which defines the opening of the container.

5. The arrangement as claimed in claim 4 wherein the outer periphery of the container lip is disposed concentrically within a projection of the inner surface of the container wall.

6. The arrangement as claimed in claim 3 wherein an annular groove-like recess surrounds the outer periphery of the container lip, the recess being defined by an outer wall which is disposed concentrically about the outer periphery of the container lip and by a flange which connects the outer wall to the container wall.

7. The arrangement as claimed in claim 6 wherein the flange is disposed at a level below that of the undercut at the underside of the bead.

8. The arrangement as claimed in claim 6 wherein the outer wall has an upper margin which lies approximately in the same plane as the lip of the container.

9. The arrangement as claimed in claim 3 wherein the bead abutting portion of the inner skirt of the closure has a section thickness which increases sharply below the bead of the container to form the radially outwardly projecting ledge.

10. The arrangement as claimed in claim 3 wherein the lip of the container and the rim portion of the closure are so formed that at least one annularly extending void is provided between the container and the closure to form an anti-capilliary gap.

11. The arrangement as claimed in claim 3 wherein the flared portion of the closure which incorporates the zone of reduced section thickness follows a curved path to merge with the central portion of the closure.

12. The arrangement as claimed in claim 3 wherein the central portion of the closure is substantially planar.

13. The arrangement as claimed in claim 3 wherein the central portion of the closure is formed as an inverted well.

* * * * *